US010340647B2

(12) United States Patent
Howard et al.

(10) Patent No.: US 10,340,647 B2
(45) Date of Patent: Jul. 2, 2019

(54) METHOD OF CONSTRUCTING A SOLDERLESS DC CABLE

(71) Applicant: TRISIMIAN, LLC, Raleigh, NC (US)

(72) Inventors: Stephen G. Howard, Raleigh, NC (US); Osman M. Ahsen, Raleigh, NC (US)

(73) Assignee: TRISIMIAN, LLC, Raleigh, NC (US)

( * ) Notice: Subject to any disclaimer, the term of this patent is extended or adjusted under 35 U.S.C. 154(b) by 331 days.

(21) Appl. No.: 15/485,028

(22) Filed: Apr. 11, 2017

(65) Prior Publication Data

US 2017/0302042 A1 Oct. 19, 2017

Related U.S. Application Data

(60) Provisional application No. 62/321,836, filed on Apr. 13, 2016, provisional application No. 62/378,802, filed on Aug. 24, 2016.

(51) Int. Cl.

| | |
|---|---|
| ***H01R 43/01*** | (2006.01) |
| ***H01R 13/59*** | (2006.01) |
| ***H01R 24/38*** | (2011.01) |
| *H01R 103/00* | (2006.01) |

(52) U.S. Cl.

CPC ..... *H01R 43/01* (2013.01); *H01R 13/59* (2013.01); *H01R 24/38* (2013.01); *G10H 2230/035* (2013.01); *H01R 2103/00* (2013.01)

(58) Field of Classification Search

None

See application file for complete search history.

(56) References Cited

U.S. PATENT DOCUMENTS

| | | | | |
|---|---|---|---|---|
| 4,995,832 | A * | 2/1991 | Thommen | F16L 25/0036 285/903 |
| 5,984,723 | A * | 11/1999 | Wild | H01R 9/0524 439/583 |
| 6,032,358 | A * | 3/2000 | Wild | H01R 9/0524 29/857 |
| 7,908,741 | B2 * | 3/2011 | Chawgo | B25B 27/10 29/748 |
| 8,366,481 | B2 * | 2/2013 | Ehret | H01R 9/05 439/578 |

(Continued)

*Primary Examiner* — Carl J Arbes

(74) *Attorney, Agent, or Firm* — Stetina Brunda Garred and Brucker

(57) ABSTRACT

Methods and systems for assembling customizable solderless cables for direct current (DC) transmission of electricity to an electronic device. The systems and methods utilize shielded co-axial cable defining first and second opposed ends which may be cut to a desired length as selected by the user. Connectors, which may have a conventional 2.1 mm×5.5 mm DC plug design, include a barrel portion defining a threaded axial passageway. In use, the threaded passageway of the plug is twisted upon a respective end of the cable such that the end of the cable becomes threadedly seated thereinto and in electrical contact with the plug to form two dedicated electrical connections. A respective other plug is mounted on the other respective end of the cable in the same manner to thus define the customizable cable. A single length of cable or a plurality of wire segments and plugs may be sold as a pre-packaged unit for use in making a plurality of customizable DC cables.

5 Claims, 2 Drawing Sheets

(56) References Cited

U.S. PATENT DOCUMENTS

| | | | | |
|---|---|---|---|---|
| 8,516,696 | B2 * | 8/2013 | Chawgo | H01R 9/0524 29/751 |
| 9,190,762 | B2 * | 11/2015 | Xu | H01R 13/502 |
| 2012/0222300 | A1 * | 9/2012 | Chawgo | H01R 9/0524 29/857 |

* cited by examiner

METHOD OF CONSTRUCTING A SOLDERLESS DC CABLE

CROSS-REFERENCE TO RELATED APPLICATIONS

The present application claims priority to U.S. Provisional Patent Application Ser. No. 62/321,836, entitled DC SOLDERLESS CONNECTOR, filed Apr. 13, 2016, and U.S. Provisional Patent Application Ser. No. 62/378,802, entitled DC SOLDERLESS CONNECTOR filed Aug. 24, 2016, the teachings of all of which are specifically incorporated herein by reference.

STATEMENT RE: FEDERALLY SPONSORED RESEARCH/DEVELOPMENT

Not Applicable

BACKGROUND

The present invention relates to methods and kits for forming customized solderless cables for transmitting direct current (DC) electricity. The present invention further relates to the cables produced by such methods.

As is well-known in the art, electricity is typically transmitted via alternating current (AC) or direct current (DC). DC works by supplying a constant electric voltage, from which most devices will draw a constant electric current. Along those lines, most modern electronics require direct current in order to operate.

In many instances, electronic devices requiring DC are adapted to draw power from a battery—a common source of direct current—or otherwise receive DC transmission from a source operative to convert AC to DC. The latter approach is considered far more favorable as AC power is the predominant form of electricity transmission made publicly accessible and further, eliminates the need to rely upon batteries as the DC power source, which would otherwise require frequent replacement or recharging on a routine basis.

To facilitate the ability to transmit DC to an electronic device, numerous standardized cables have been developed. Perhaps the most common of such cables is the 2.1 mm×5.5 mm DC cable operative to interconnect with male and female plugs/sockets. Such cables come in a wide variety of lengths and are typically provided with either a straight or right-angle plug configuration.

Despite the widespread availability of such cables, however, there is not yet presently available any type of system and method by which customized DC cables can be easily and readily created, as well as created in a manner that results in an exceptionally durable cable that is structurally robust, capable of long product life and is designed to deliver a maximum degree of current transmission. There is particularly lacking such a system and method for creating a DC cable that dispenses with the need to form a solder connection between the respective plugs formed on the end of such cable and the cable through which electricity is transmitted.

Due to the lack of any systems and methods for forming such DC cables, numerous difficulties have arisen in a number of applications. Exemplary of the difficulties associated with using standardized DC cables include the supply of power to multiple guitar effects pedals operatively combined with one another as part of an effects pedalboard. As is well-known to those skilled in the art, guitar effects pedals are utilized extensively in connection with electric guitar amplification and are operative to modify the signal transmitted from the electric guitar to a guitar amplifier. Such pedals are designed to impart effects such as distortion, chorus, delay, flange and numerous others as can be selectively chosen by the player. Typically, each pedal is responsible for a single effect, and a plurality of pedals are arranged in a particular sequence upon a pedalboard, which can take countless different forms, spatial arrangements, different types of pedals of different sizes made by a variety of manufacturers that are all dependent upon the particular tastes of the guitarist (and often times the guitarist's guitar tech).

Given the drastic variation in the layout and configuration of the specific guitar effects pedals upon a pedalboard, substantial difficulty arises in supplying power to each specific effects pedal. As discussed above, the use of batteries is completely impractical as it is far too labor intensive and time consuming to continuously monitor and replace the numerous number of batteries that would be used in connection with such pedals. The use of standard DC cables to run power from an AC to DC conversion electricity source is likewise problematic insofar as the spatial arrangement of the effects pedals, as discussed above, can vary greatly and standardized cables provide no means whatsoever to customize the same to a specific length as would be desirable for such applications.

While the ability to make custom DC cables can be readily accomplished, such task typically involves the step of soldering the plugs to the respective ends of the wire forming the cable. Such process, however, is time consuming, requires soldering equipment, skill in knowing how to properly solder and carries risk of injury given the heat and melting of solder needed to form an ideal electrical connection.

Accordingly, there is a substantial need in the art for systems and methods that enable a customized DC cable to be easily and readily fabricated. There is likewise a need in the art for such systems and methods that rely on a simple, easily understood construction, fast and exceedingly simple to assemble, capable of being precisely customized to exact specifications, and operative to produce cables that are exceptionally durable and capable of maximizing current flow therethrough and without the need for soldering.

BRIEF SUMMARY

The present invention specifically addresses and alleviates the above-identified deficiencies in the art. In this regard, the present invention is directed to methods and kits for forming solderless DC cables for delivering a direct electrical current via conventional wiring connections, and in particular through conventional plugs and sockets per conventional male/female fittings. Advantageously, the methods and kits of the present invention enable such cables to be formed to selectively chosen lengths and further, result in DC cables that are exceptionally durable and maximize transmission of DC electricity without having to form solder connections.

According to a preferred embodiment, the methods and kits deploy sheathed electrical cable for transmitting DC electricity and possess a specified length defining first and second opposed ends. Per conventional sheathed wire, such cable will comprise a coaxial cable consisting of an inner conductive core, a core insulator wrapped thereabout, a metal conductive shield extending about the core insulator, and an outer shearable sheath. As the outer layer suggests, the shearable sheath is selectively chosen to be shearable in nature so as to expose the metal conductive layer underneath, as discussed herein.

Attachable to the respective ends of the cable are connectors or plugs designed to have a conventional fitting formed thereon. According to a preferred embodiment particularly well suited for the formation of cables for use with guitar effects pedalboards, the plugs will take the form of a conventional 2.1 mm plug. Such plug, which will typically take the form of a male plug portion, will be configured to have a proximal barrel portion operative to receive and interconnect with a respective one of the opposed ends of the cable and an exterior male distal end or sleeve extending therefrom forming the conventional plug portion. The proximal barrel portion further has a threaded axial passageway disposed therein.

Within the distal interior of the axial passageway is a pin assembly having a registry pin for forming an electrical connection with the wiring encased within the inner core of the cable that is operative to transmit the current through an internal sleeve or male end of the plug (i.e., the "hot" tip) per conventional electrical interconnections. An annular non-conductive sleeve is interposed between the outer sleeve portion extending from the barrel portion and the internal sleeve of the internal pin assembly to thus enable the transmission of two separate currents, as will be understood by those skilled in the art.

In use, a respective one of the ends of the cable is introduced within the axial passageway of the barrel portion of the plug with the plug thereafter being rotated clockwise thereupon such that the threads within the axial passageway shear through the shearable outer sheath and expose the metal conductive shield about the distal end of the cable. Through such process, the inner core within the end of the cable is caused to securely contact and form an electrical connection with pin extending thereinto from the distal end of the interior pin assembly. The shearing force of the threads against the sheath of the cable ensures that the inner core wiring will ideally interconnect with the pin. Moreover, due to the actual positioning of the pin within the passageway, an optimal electrical connection is thus formed. Still further, by virtue of the threaded engagement between the threads of the axial passageway and the metal conductive shield about the distal end of the cable, a second electrical connection is established to allow for a second dedicated current flow. In this regard, the shearing action of the threads is operative to only form an electrical connection between the threads of the axial passageway and the metal conductive shield lying there underneath and does not extend past the core insulator wrapped about the conductive inner core. Moreover, such threaded engagement causes the interconnection between the distal end of the cable and the interior of the barrel portion of the plug to become extremely secure and durable, and dispenses with the need to form a solder connection.

To the extent the cable assumes the desired length, the same process is repeated with respect to another like plug as attached to the respect other end of the cable. Alternatively, once a plug is securely attached to a respective end of the cable, the cable may be cut to a desired length and then a second like plug may be attached, with the end result being a DC solderless cable having conventional plugs securely attached at the ends thereof with the cable having a length as specified by the user. Such cable may then be utilized per conventional DC electricity transmission applications, and in particular for use in transmitting energy from an AC to DC power source into a DC electronic device, such as a guitar effects pedal. To the extent desired, plugs may be used that form either straight or right angle connections.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be implemented or performed. The description sets forth the functions and sequences of steps for practicing the invention. It is to be understood, however, that the same or equivalent functions and sequences may be accomplished by different embodiments and that they are also intended to be encompassed within the scope of the invention.

Figure 1:
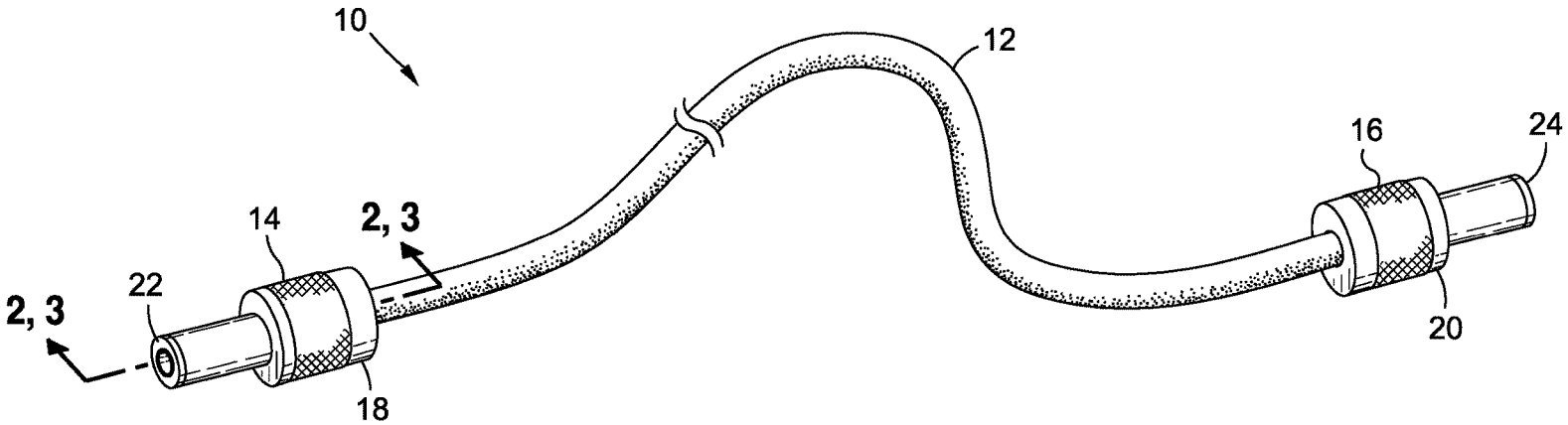
FIG. 1 is a perspective view of a solderless DC cable having conventional 2.1 mm male plugs formed on the respective ends thereof as assembled by the methods and kits of the present invention.

Referring now to the figures, and initially to FIG. 1, there is shown a DC cable 10 as constructed in accordance with a preferred embodiment of the present invention. As illustrated, the cable 10 assumes the configuration of a conventional 2.1 mm DC cable having an intermediate cable portion 12 with 2.1 mm plugs 14 and 16 fitted on the opposed ends thereof. Per conventional 2.1 mm plugs, plugs 14,16 include barrel portions 18, 20 respectively, as well as male pin portions 22, 24, respectively. Such cables as 10 are utilized in a conventional manner to transmit DC electricity therethrough via the use of conventionally sized fittings such as 14,16. Advantageously, however, the cables 10 of the present invention are operative to be easily and readily fabricated such that the cable portion 12 may have a desired length and further, plugs 14,16 may be easily, readily and securely attached to cable 12 at the opposed ends thereof without the need of forming a soldered connection.

Figure 2:
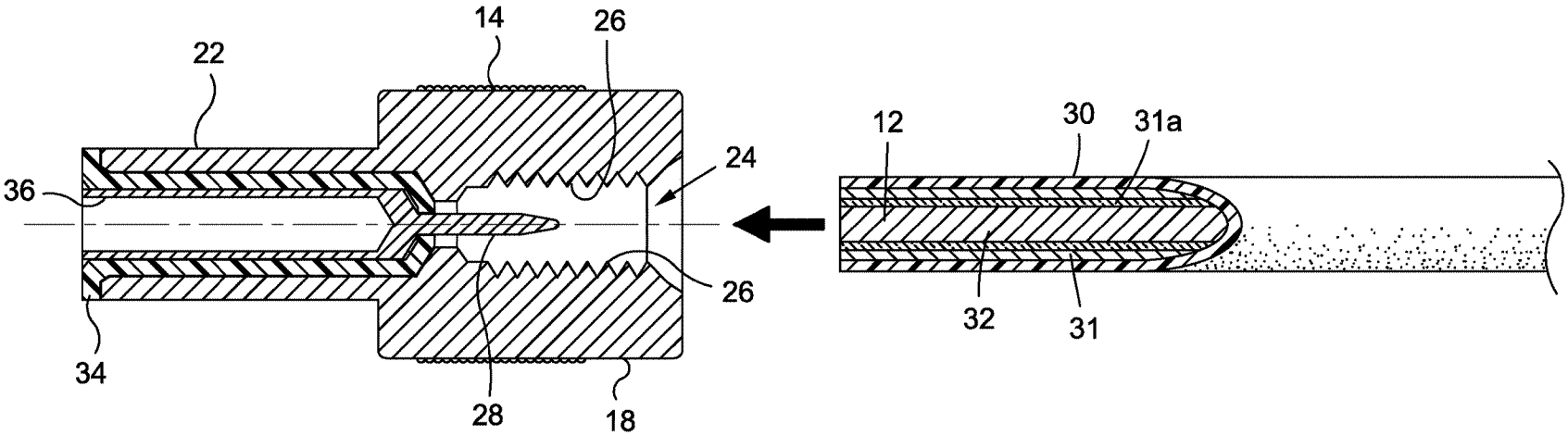
FIG. 2 is an exploded view, partially in cross-section, of a respective plug as attached to a respective end of a cable as taken along line 2-2 of FIG. 1.
Figure 3:
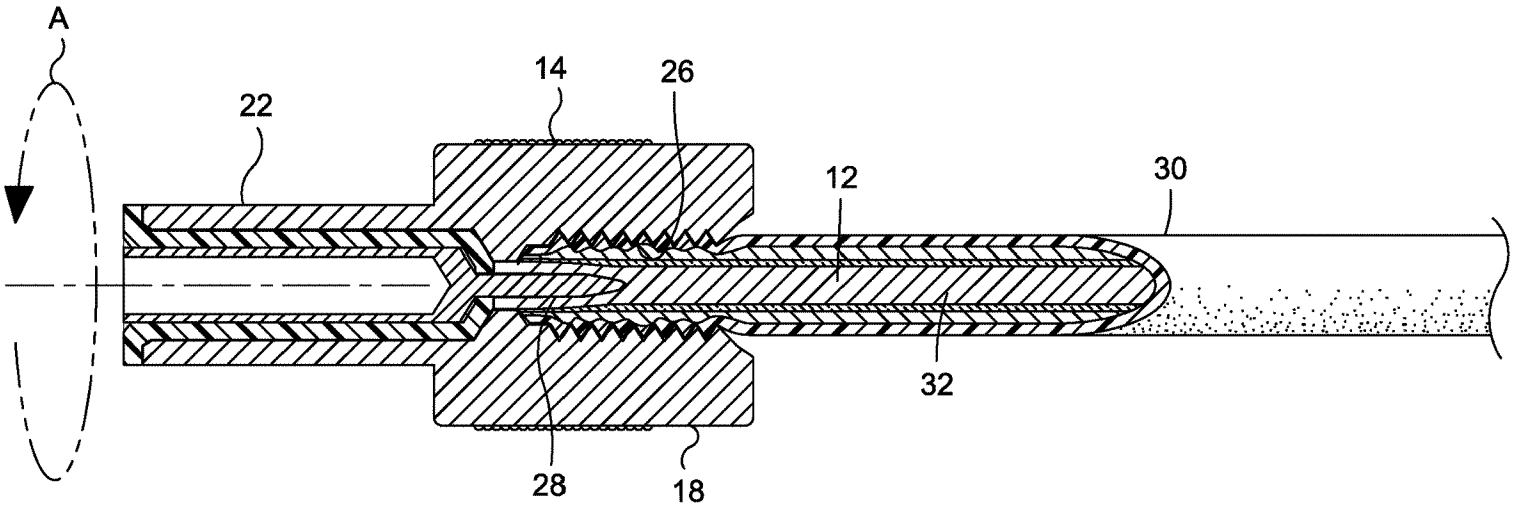
FIG. 3 is a view taken along line 3-3 of FIG. 1, partially in cross-section, showing the assembly procedure for assembling a plug to a respective end of the cable.

To accomplish that end, the DC cable 10 of the present invention are assembled via the interconnection of the respective plugs 14,16 to the opposed ends of cable 12 in the manner depicted in FIGS. 2 and 3. As shown, cable 12 comprises a coaxial cable operative to facilitate the transmission of two signals. Specifically, a first current is transmissable via a conductive inner core 32, about which is wrapped a core insulator 31*a*. Axially encased about the core insulator 31*a* is a metal conductive shield 31, which is thus electrically isolated from the inner core 32 and operative to facilitate the transmission of the second separate, independent signal. Wrapped about the metal conductive shield 31 is a shearable outer layer 30, which is operative to electrically insulate the metal conductive shield 31 unless otherwise selectively sheared or shred therefrom to enable an electrical connection to be made, as discussed more fully below.

Figure 4:
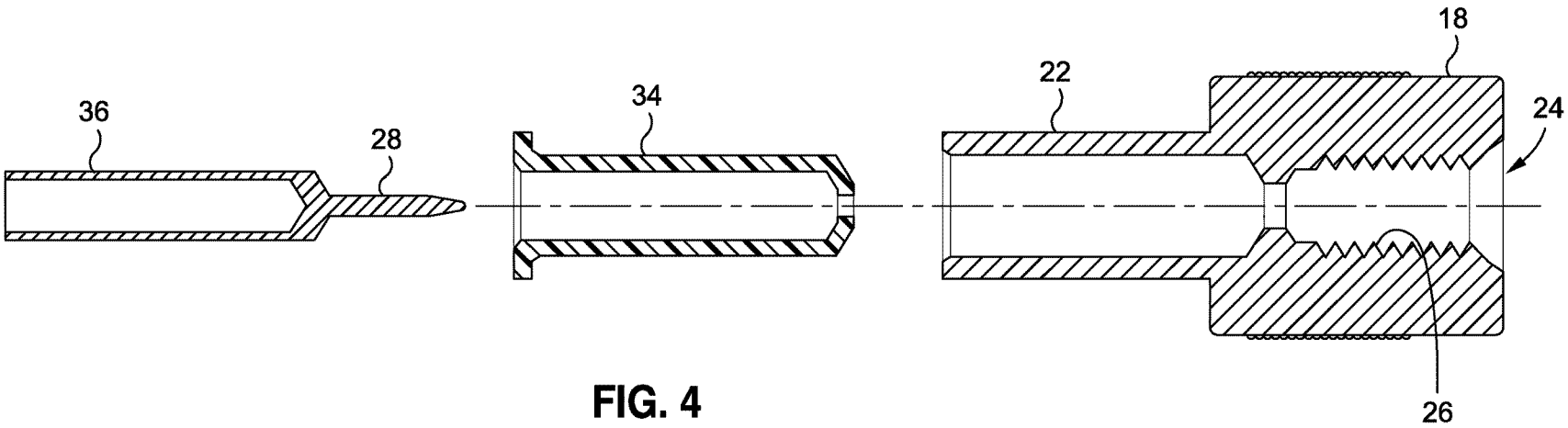
FIG. 4 is an exploded view of the components of the plug assembly for forming the DC solderless cables of the present invention.

The opposed ends of the cable 12 are designed to interconnect and form an electrical connection with a respective plug, such as 14 as shown in FIG. 2, as well as exploded view of FIG. 4. With respect to the latter, plug 14 includes an outer barrel portion 18 with male sleeve portion 22 extending therefrom. Such plug 14 is designed to have a conventional 2.1 mm configuration whereby external sleeve portion 22 is operative to interconnect with and transmit DC electricity per conventional fittings well-known in the art. To accomplish that end, plug 14 is configured such that the barrel portion 18 has an axial passageway 24 extending therewithin from the proximal side thereof. Such axial passageway 24 is defined by a periphery of threads 26 that are operative to be twisted or rotatably mounted upon the end of the cable 12 to which the plug 14 is attached. Plug 14 further includes an internal pin assembly that comprises conductive sleeve 36 having a pin 28 extending rearwardly therefrom and into the axial passageway 24 of barrel 18. Insulating sleeve 34 is further provided so as to prevent current transmitted through sleeve 36 to anything than the socket to which the plug 14 is connected, including outer sleeve portion 22. Such plugs 14 have recently become commercially available from 3 Monkeys Amps, of Raleigh, N.C. Also, although depicted in the figures as having a straight or 180° linear configuration, it will be readily understood by those skilled in the art that plugs 14,16 may also be formed to have a right angle or 90° orientation as may be desired for a particular application.

Referring now to FIG. 3, there is shown the manner by which an end of cable 12 is interconnected with plug 14 as shown in FIG. 2. As illustrated, plug 14 is rotated in a clockwise fashion as indicated by the letter "A" such that threads 26 are caused to compress against and shear through sheath 30 as the end of the cable 12 is advanced into the axial passageway. By virtue of the concentric orientation of pin 28 within axial passageway 24, the threads 26 thus cause interior wiring 32 to concentrically encase pin 28 to thus establish an optimal degree of electricity transmission. In this regard, by maintaining a concentric relationship between core wiring 32 and pin 28, a secure connection is easily and readily established that further dispenses with the need of having to strip coaxial cable.

At the same time, a second, independent electrical connection is established by virtue of threads 26 that have sheared through outer layer 30 and subsequently brought into contact with metal conductive shield 31. In this regard, the threads 26 are operative to only shear through outer layer 30 and form an electrical contact with metal conductive shield 31 but not shear through core insulator 31*a*, which in turn maintains an electrically insulated covering about inner core 32. As a consequence, electrical signal pathways are established both by inner core 32 with pin 28 and ultimately internal male pin portion 36, in one direction, and separately through outer sleeve portion 22, which in integrally formed as part of barrel portion 18 and threaded portion 26 thereof with metal conductive shield 31.

Such interconnection advantageously dispenses with the need to form any type of soldering connection, as discussed above, as well as dispenses with the need of any type of screws that are frequently deployed to secure plugs to the cables with which they are connected that are widely recognized in the art as being exceptionally problematic. In this regard, the user need only make a clean, straight cut of the cable 12 using a utility knife with a sharp blade in order to form a connection between the end of the cable 12 and a connector 14. Such clockwise twisting is performed to the point to where the end of the cable 12 is fully nested within the axial passageway formed within bore 18, a point that is reached when the plug 14 is "finger tight" or cannot be advanced further without applying excessive force.

As will be appreciated by those skilled in the art, the sheath or jacket 30 formed about metal conductive shield 31 of cable 12 should be selectively chosen to shear when contacted with threads 26. Exemplary of commercial wiring suitable for the practice of the present invention including a cable jacket 30 capable of shearing includes Part No. 8 1C16-1430SB, produced by Anixter, Inc. of Glenview, Ill. Cables 12 that do not include a shearable jacket will not be ideal for the practice of the present invention.

As discussed above, the spiral shearing accomplished by threads 26 are operative to facilitate the electrical connection between threads 26 and metal conductive shield 31, on one hand, and interior wiring 32 and pin 28, on the other. Such action also causes the end of the cable 12 to become securely seated and permanently nested within the axial passageway of bore 18. In this regard, the compressive force by thread 26 forms a 360° interconnection that forms a nearly perfect concentric relationship between threads 26 and shield 30 and the core of the cable 32 and the pin 28, especially insofar as the pin 28 is driven into the core wiring 32 that, in turn, maximizes the contact between such elements and eliminates the need for a solder-like connection.

In order to cause the DC solderless cables of the present invention to assume the desired length, the cable 12 may be cut to have a pre-determined length prior to the attachment of the plugs 14,16 on the opposed ends thereof or, alternatively, a first plug 14 may be mounted on a respective end of the cable 12, and thereafter the length of cable 12 measured to a desired length and subsequently cut to define the other end of the cable to which the respective other plug 16 may be attached. In this regard, the attachment of second plug 16, not shown, is identical to that as discussed above with respect to plug 14. Advantageously, because each respective plug 14,16 is threadably mounted upon the respective opposed ends of cable 12 via clockwise threaded engagement, such plugs 14,16 are consequently caused to assume a more secure attachment to the respective ends of cable 12 insofar as to remove a respective 14,16 would require the same be rotated counterclockwise relative the cable 12, which consequently has an opposite effect on the opposite end of cable 12 and plug to which it is attached. A more secure attachment to the opposed end is thus created by virtue of the torsional system by which the respective plugs 14,16 are attached to cable 12. Indeed, such interconnection is so secure, that any type of conventional locking material or mechanism, such as screws, glue and the like, are completely unnecessary.

In order to more easily and readily practice the methods of the present invention, it is contemplated that a plurality of cable segments 12 and plugs 14,16 may be pre-packaged and sold as a kit to thus enable a plurality of cables of the present invention 10 to be performed. To that end, it is contemplated that two plugs 14,16 will be provided for each segment of cable 12 or, alternatively, a certain number of pairs of plugs 14,16 may be sold in connection with a single length of cable 12, the latter may be cut to specific lengths as may be selectively chosen by the user. For example, it is contemplated that a kit may include ten plugs (i.e., 5 pairs) in combination with ten feet of cable 12, the latter of which being cut to specific lengths and used with a respective pair of plugs 14,16 as may be desired.

Additional modifications and improvements of the present invention may also be apparent to those of ordinary skill in the art. For example, while discussed herein for the creation of DC cables, it is expressly contemplated that the methods of the present invention and the cables formed thereby may also include any bi-filler (i.e., bi-polar) connection, such as for AC applications and the transmission of audio signals. Thus, the particular combination of parts and steps described and illustrated herein is intended to represent only certain embodiments of the present invention, and is not intended to serve as limitations of alternative devices and methods within the spirit and scope of the invention.

What is claimed is:

1. A method for constructing a solderless DC cable comprising the steps:

a. providing a cable operative to transmit a DC current, said cable having a conductive inner core, a core insulator wrapped about said inner core, a metal conductive shield formed about said core insulator and a shearable outer jacket;

b. providing first and second plugs, said first and second plugs being operatively functional as conventional 2.1 mm male connectors, each respective first and second plug having an outer barrel portion defining a proximal end and a distal end, said barrel portion having an external male sleeve portion extending from the distal end thereof, said barrel portion further defining a threaded axial passageway extending into the proximal side thereof, said external sleeve, barrel portion and threaded portion all being in electrical communication relative one another, each respective first and second plug further having an internal pin assembly disposed within said barrel portion of said plug whereby said internal pin assembly includes a distally extending conductive sleeve and further including a conductive pin extending proximally therefrom and into said threaded axial passageway, each respective first and second plug further having a non-conductive electrically insulated sleeve disposed between and separating said barrel portion and distal male sleeve extending therefrom from said internal pin assembly;

c. defining a first respective end of said cable provided in step a) and inserting said end within said axial passageway of a respective one of said plugs provided in step b);

d. rotating said plug upon said end of said cable such that said threads within said axial passageway shear said outer jacket of said cable such that said threads of said barrel portion electrically contact said metal conductive shield of said cable, said end of said cable being advanced within said axial passageway to a degree sufficient for said pin of said internal pin assembly to establish electric communication with said inner core of said cable;

e. defining a second respective end of said cable provided in step a) and inserting said second end within said axial passageway of said respective other of said plugs provided in step b); and f. rotating said respective other plug upon said second end of said cable such that said threads within said axial passageway shear said outer jacket of said cable such that said threads of said barrel portion electrically contact said metal conductive shield of said cable, said second end of said cable being advanced within said axial passageway to a degree sufficient for said pin of said internal pin assembly to establish electric communication with said inner core of said cable.

2. The cable formed by the method of claim 1.

3. The method of claim 1 wherein step c) comprises making a cross-sectional cut through said cable to define said first respective end and wherein in step e) comprises making a cross-sectional cut through said cable to define said second respective end.

4. The method of claim 1 wherein said cable provided in step a) has a selectively chosen length.

5. The method of claim 1 wherein said cable of step a) and said plugs of step b) are provided as part of a pre-packaged kit.

* * * * *